US005871817A

United States Patent [19]

Nasheri

[11] Patent Number: 5,871,817

[45] **Date of Patent: *Feb. 16, 1999**

[54] LIQUID BORON PRESERVATIVE PROCESS

[75] Inventor: Kourosh Nasheri, Rotorua, New Zealand

[73] Assignee: New Zealand Forest Research Institute Ltd., Rotorua, New Zealand

[ * ] Notice: This patent issued on a continued prosecution application filed under 37 CFR 1.53(d), and is subject to the twenty year patent term provisions of 35 U.S.C. 154(a)(2).

[21] Appl. No.: 501,547

[22] Filed: Jul. 12, 1995

[51] Int. Cl.[6] ..... B05D 3/02

[52] U.S. Cl. ..... 427/317; 427/325; 427/393; 427/393.3; 427/440

[58] Field of Search ..... 427/317, 440, 427/325, 393, 397, 393.1–393.4; 106/15.05; 252/380, 607

[56] References Cited

U.S. PATENT DOCUMENTS 5,024,861 6/1991 Vinden et al. ..... 427/254
5,330,847 7/1994 Murphy et al. ..... 428/537.1

*Primary Examiner*—Brian K. Talbot
*Attorney, Agent, or Firm*—Whitman Breed Abbott & Morgan, LLP

[57] ABSTRACT

The invention comprises a process for the preservation of timber, wood or wood based products with a boron based preservative. The preservative comprises a mixture of boric acid or boron oxide with one or more solvents selected from the group consisting of methanol and ethanol.

11 Claims, 1 Drawing Sheet

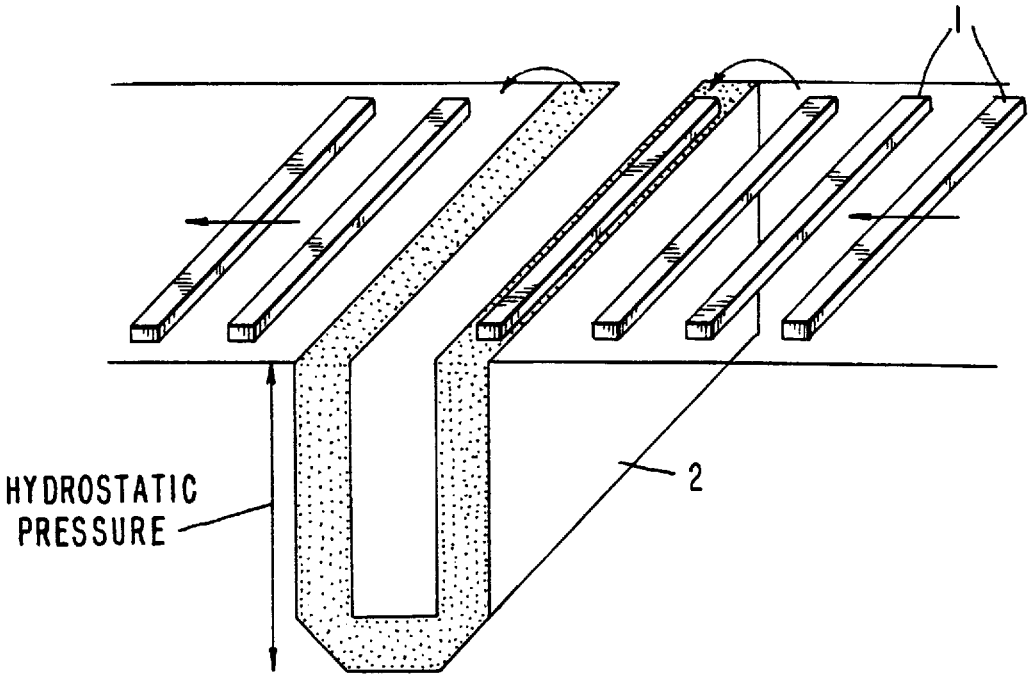
1
2
HYDROSTATIC
PRESSURE

LIQUID BORON PRESERVATIVE PROCESS

FIELD OF INVENTION

The present invention comprises a timber preservation process.

BACKGROUND

Compounds of boron have been used as preservatives for timber for many years. Typically such compounds of boron are applied to timber to be treated by dipping of the timber in a bath or the like comprising of an aqueous solution of the boron compound. After, dipping the timber must remain under non-drying conditions for sufficient time for the boron to diffuse into the timber, which can be of the order of weeks or some months, and thus the preservation process is relatively time consuming. In commercial terms it is desirable to minimise standing time for timber stocks.

The more rapid preservative treatment of timber with a boron compound by treating the timber with the boron preservative in the vapour phase is known. Some compounds of boron are either low boiling point liquids or gases. When placed in contact with timber or wood-based products, selected compounds undergo chemical reaction with the wood or residual wood moisture whereby boron as compounds of boron is deposited in the timber. For example, on contact with wood trimethyl borate reacts, it is believed with wood moisture, to deposit in the wood material as boric acid.

SUMMARY OF THE INVENTION

The present invention provides an improved or at least alternative process to the vapour or gas phase boron preservative treatment of timber which also offers much improved speed of treatment over traditional dipping type water based processes.

In broad terms the invention comprises a process for the preservation or remedial treatment of timber or wood based products with a boron based preservative, comprising contacting the timber with a liquid preservative comprising a reactive boron compound after first drying the timber sufficiently to allow rapid penetration of the preservative into the wood whereby boron or a compound of boron becomes deposited within the wood.

Preferably the wood is dried to a mean moisture content below 18% by weight, and most preferably to or below 12% to 14% by weight.

Preferably the wood is contacted with the liquid boron preservative by dipping or spraying or other technique to contact the treatment chemical in liquid phase with the wood.

With the process of the invention where the wood is first dried to a low moisture content and then contacted with the liquid boron preservative, boron preservation treatment may be carried out far more rapidly than with water based boron dipping processes which have been conventional for many years. Immediately or in a relatively short time after treatment the timber is in a suitable condition for use or sale, so that standing of the timber under non-drying conditions for long periods after treatment to allow the boron preservative to diffuse sufficiently into the timber as in conventional boron preservative treatment processes is not required. The process of the invention is particularly suitable for the preservative treatment of sawn timber intended for dry framing or the like and enables such timber to be sawn, optionally dressed, and then preservative treated very quickly and even in a matter of only a few hours. The actual preservation stage may be carried out in only a few minutes or even in less than one minute.

The process of the invention is particularly suited for the in-line or continuous treatment of rough-sawn or even planed timber. In such a case preferably all the treatment steps of the preservation process of the invention are carried out with a common treatment system comprising a wood classification and improvement section, a drying section, a preservative dipping or spraying section and an optional facility for recovery and recycling of reacted and unreacted components of the treatment chemical, but it is possible for the treatment to be effected in an existing drying and conditioning plant with the dipping/spraying treatment being carried out in a separate reaction vessel or treatment bath.

BRIEF DESCRIPTION OF THE DRAWING

FIG. 1 is a view of timber being treated with the preservative of the invention.

DETAILED DESCRIPTION OF INVENTION

Reactive boron compounds which may be employed in the dipping/spraying treatment comprise any suitable compound of boron that will deposit boron as a compound or compounds of boron in the wood material including trimethyl borate, methyldiborane, trimethylborane, dimethyldiborane, trimethyldiborane, and borine carbonyl for example, or any other suitable boron compound including azetropes or mixtures of these compounds with other compounds such as methanol or other suitable solvents, for example. Mixtures which generate reactive boron compound in situ may also be used. Mixtures of boric acid and methanol for example, or another alcohol, may be used as these generate boron esters which are available by the dipping or spraying process for penetration into the wood. Compounds may be selected having regard to their flammability/stability, reactivity with wood or wood moisture, and toxicity. A preferred compound is trimethyl borate and methanol at or at about the azeotropic composition thereof or a mixture of boric acid or oxide or any other boron compound with methanol. Also present along with the boron preservative compound may be another preservative as a minor component or an insecticide or fungicide or similar, such as a synthetic pyrethroid including permethrin, deltamethrin, or cypermethrin, inorganic or organic copper salts, organotin compounds, or azole compounds, for example.

In accordance with the process of the invention the timber is firstly dried to a low moisture content. For example the wood may be dried to a mean moisture content of about 12% to 14% of the oven dry weight of the wood. With the invention reduction of the timber moisture content to these low levels allows deposit of the boron, or compounds in which boron is present, into the wood with good distribution of the boron throughout the cross-sectional area of the wood during the dipping or spraying and without long diffusion times under non-drying conditions after treatment, if any, and also the dipping or spraying process itself as well as entering the boron preservative into the wood also has a conditioning effect on the wood, raising its moisture content to a higher level again to prevent any permanent damage that would otherwise result from drying to such low moisture contents.

High temperature drying to reduce the moisture content of the wood is preferred and any suitable drying schedule to achieve a desired wood moisture content prior to dipping/spraying treatment for any particular wood species or type may be employed. Other drying techniques may be employed however, such as conventional drying up to temperatures of 100° C., vapour recompression drying, vacuum drying, or radio-frequency drying, for example, or air drying.

After drying the timber is immersed in or sprayed with the boron compound or formulation, and penetration of the wood material allowed to occur. Penetration is typically rapid but dependent upon wood dimensions. For 90×45 mm pieces of timber preservation is typically complete in 40 seconds. Another benefit of the process of the invention is that it is possible to control speed and depth of preservative penetration and the amount of boron deposited in the wood by controlling the time and depth of immersion of the wood in the preservative or by otherwise controlling the hydrostatic pressure to which the wood is subjected during dipping.

Preferably the dipping/spraying process is carried out at ambient or near ambient pressure and temperature conditions, but treatment could be carried out under elevated pressure, alternating pressure or under vacuum conditions, in combination with heating and/or cooling, or the like.

For application by spraying, preservative is sprayed onto the wood surfaces preferably in an atomised spray in a controlled manner. High chemical loadings may be obtained using additional spraying nozzles or by a repeat application of chemical.

Optional recovery of unreacted treatment chemical or of volatile products of reacted treatment chemical may be achieved by utilising a chamber fitted for continuous passage of wood material. Hot air is circulated through the chamber, and passed through a cooling facility designed for removal by condensation of volatile materials. An optional method of recovery of boron compounds is to apply water in any form, to hydrolyse the residual unreacted chemical.

As stated, the process of the invention may be configured as a rapid treatment in an on-line production situation where the timber passes through a drying stage followed by a boron treatment stage on a production line. Drying may be immediately preceded by sawing and optionally dressing stages. The accompanying drawing schematically shows part of treatment of wood according to the process of the invention is such a production line situation. Lengths of timber 1 exiting a drier (not shown) pass through a U-shaped preservative treatment bath 2. For example a conveyor such as a chain conveyor may pull the pieces of timber through the treatment bath against the natural buoyancy of the wood. As the pieces of wood pass through the treatment bath they are subjected to hydrostatic pressure which assists in impregnating the preservative into the wood. By controlling the depth to which the timber is immersed the amount of hydrostatic pressure applied to the wood can be controlled which gives control over the process as discussed above. Typically the wood may be immersed to a depth of up to 4 meters or more according to its moisture content. The higher the moisture content of wood, the deeper is the bath depth used. The pieces of wood may be standard length pieces of wood such as pieces of framing timber and they may be preservative treated in a matter of minutes or less. On exit from the treatment bath the conveyor may carry the pieces of wood to an optional solvent recovery stage and to any further stages before stacking of the timber ready for sale.

EXAMPLES

The following examples further illustrate the process of the invention:

Example 1

Lengths of 100×50 mm Radiata Pine sapwood were dried in a high temperature drier using a standard high temperature drying schedule of 120° C. dry bulb, 70° C. wet bulb to approximately 7% moisture content by weight (oven dry basis). The timber was held for 17 hours after drying and then each length of timber was dressed and cut into 350 mm sections which were then end sealed with PVA glue to stop longitudinal penetration. A section of wood from each original length was then treated as follows:

a) the wood was immersed for 40 seconds in trimethyl borate-methanol azeotrope 35.67% w/v BAE (boric acid equivalent) and then excess liquid allowed to evaporate off in an air flow.

b) the wood was immersed for 40 seconds in the same trimethyl borate-methanol azeotropic mixture as in a) above and the pieces were wrapped in plastic to prevent loss of excess liquid.

c) the wood was immersed for 120 seconds in the same trimethyl borate-methanol azeotropic mixture as in a) above and the pieces were wrapped in plastic to prevent loss of excess liquid.

A thin cross section was then cut from the middle of each section for moisture content determination after treatment and the boron uptake of each section was determined by weight gain. Spot testing to indicate the depth of penetration by boron compounds was carried out using pyrocatechol violet test (PCV). It was found that in all cases preservative had penetrated to a depth of 10 mm (flat sawn). The calculated percentage weight gains and end moisture contents were as follows (averaged across all samples):

| | Procedure | % Boric Acid (weight gain) | % Moisture Content After Treatment |
|---|---|---|---|
| 40 seconds dip | a) | 0.98 | 9.2 |
| 40 seconds dip followed by wrapping | b) | 1.06 | 9.2 |
| 120 seconds dip followed by wrapping | c) | 1.05 | 9.2 |

The results show that in the case of the samples which were dipped for 120 seconds the boron uptake was no greater than for the samples dipped for 40 seconds indicating that preservative penetration had been optimised after only 40 seconds.

Example 2

Pieces of green 100×50 mm Radiata Pine sapwood were cut into 600 mm lengths which were each end sealed with two coats of aluminium paint. Using a small kiln the wood was then dried for 26 hours at 120° C. dry/70° C. wet bulb to average 1.6% moisture content. All pieces were dipped in an azeotropic mixture of trimethyl borate and methanol (35.67% w/v BAE), some 5 hours after drying and some 24 hours after drying. Dip time in all cases was 40 seconds and all samples were wrapped in plastic bags after treatment.

It was found by Boron spot test that in all cases the preservative had penetrated totally through the wood. The calculated average percentage weight gain and end moisture content of the samples were as follows:

| Procedure | % Boric Acid (Weight Gain) | % Moisture Content After Treatment |
|---|---|---|
| Dipped 5 hours after drying | 1.36 | 4.6 |
| Dipped 24 hours after drying | 1.31 | 5.1 |

Example 3

10 pieces of 100×50 mm Radiata Pine sapwood each two meters long were high temperature dried to 3.8% moisture content. After 17 hours the timber was planed to nominal frame size and cut into 285 mm lengths each piece was end sealed with PVA glue. All samples were measured and weighed before treatment, and wrapped in plastic bags immediately after treatment. The bulk weight of each charge including the plastic bag was recorded before and after treatment.

Charges A and D were treated with the same treatment schedule but with a different treatment solution: charge A was dipped in boric acid in methanol for 40 seconds; charge D was dipped in trimethyl borate azeotrope mixture for 40 seconds. Charge B was dipped in the same treatment solution as charge A for 40 seconds and was then removed and pressurised to 30 kPa air pressure for 10 minutes. Another charge, charge C was dipped into a solution of methanol and boric acid and pressurised immediately to 15 kPa for 10 seconds to simulate the hydrostatic pressure from dipping the samples in a treatment bath. (One meter height of working solution by density of 0.86 is approximately equal to 8 kPa pressure). The total contact time of the wood with the solution was 40 seconds. After treatment the samples were tested for boron uptake by weight gain and boron penetration by spot test and the moisture content of the samples were determined. The averaged results are given in following table:

| Procedure | % Boric Acid (Weight Gain) | % Moisture Content After Treatment | Depth of Penetration Flat Sawn (mm) |
|---|---|---|---|
| A | 0.43 | 7.52 | 5 to 15 |
| B | 0.43 | 7.52 | 5 to 15 |
| C | 0.77 | 10.41 | 15 to Total |
| D | 1.22 | 6.96 | 15 to Total |

It can be seen that for better penetration of boron into higher moisture content (3.8%) wood in a short time, a hydrostatic pressure is needed specially if solution of Boric Acid in methanol is used.

Finally the residual stress in the samples was determined by cutting prong samples from charges C and D also from untreated unconditioned matched pieces. This showed that untreated controls were under stress, charge D was not stressed and charge C had reversed stress.

Example 4

A treatment solution of boric acid in methanol was prepared by mixing bulk boric acid and methanol to 10% w/v concentration). 12 pieces of one meter long 90×45 mm Radiata pine were high temperature dried to 13% moisture content and cut into 285 mm lengths, each of which was end-sealed with aluminium epoxy paint. All samples were measured and weighed before treatment and wrapped in plastic bags immediately after treatment. The bulk weight of each sample charge including the plastic bag was recorded before and after treatment. Charge T was dipped into the solution of methanol and boric acid and pressurized immediately to 20 kPa for 60 seconds. The total contact time of wood with solution was 80 seconds. Another charge W was treated exactly the same as charge T except that water was used as the solvent instead of methanol in the treatment solution. The averaged results are given in the following table:

| | % Boric Acid (Weight Gain) | % Moisture Content After Treatment | Depth of Penetration |
|---|---|---|---|
| Methanol Solvent | 0.93 | 20.28 | Complete |
| Water Solvent | 0.93 | 20.38 | Incomplete |

By boron spot test it can be seen that penetration of boron is complete in all charge T samples but charge W samples did show incomplete penetration of boron. Average chemical analyses of boric acid in the core (centre) of charge T samples are 130% more than W (proof of better penetration). Charge W was used as control in this example. Thus treatment of higher moisture content wood by hydrostatic pressure to achieve total penetration of boron is possible. Penetration of chemicals can be regulated by adjustment of dip tank depth and contact time. Adjustment of penetration Comparison of example 3, four charges

| Charge No. | Preservative | Treatment Schedule | Penetration Flatsawn (mm) | Initial MC | CV % | Final MC | CV % |
|---|---|---|---|---|---|---|---|
| A | Boric acid + Methanol | 40 Seconds dip | 5 . . . 15 | 3.8% | 19.8% | 7.52% | 11.8 |
| B | Boric acid + Methanol | 40 Seconds dip + pressure | 5 . . . 15 | 3.8% | 19.8% | 7.52% | 13.92 |
| C | Boric acid + Methanol | Simulated Static Pressure | 15 . . . total | 3.8% | 19.8% | 10.41% | 14.4 |
| D | TMB Azeotrope | 40 Seconds dip | 15 . . . total | 3.8% | 19.5% | 6.96% | 17.29 |

MC = Moisture Content
CV % = Coefficient of Variability depth for different wood thicknesses are possible by altering the above variables.

Comparison of charges T and W

| Charge No. | Preservative | Calculated retention % $H_3BO_3$ (m/m) | Analytical Cross section retention % $H_3BO_3$ (m/m) | Analytical Core retention % $H_3BO_3$ (m/m) |
|---|---|---|---|---|
| T | Boric acid + Methanol | 0.93 | 0.84 | 0.61 |
| W | Boric acid + Borax in Water | 0.93 | 0.69 | 0.30 |

Example 5

Boric acid in methanol as the treatment solution was prepared by mixing bulk boric acid and methanol to 10% w/v concentration. Pieces of 285 mm long 90×45 mm Radiata Pine were high temperature dried to 13% average moisture content and end-sealed with aluminium epoxy paint. This charge was immersed into the solution of methanol and boric acid and pressurised immediately to 20 kPa for 60 seconds so that the total contact time of wood with the solution was 80 seconds. The samples were weighed before and after treatment and transferred to a 70° C. oven immediately after treatment. The treatment schedule was exactly the same as for charges T and W in Example 4 but the wood was immediately transferred to the oven instead of being wrapped in a plastic bag. The weight loss of each sample was recorded at 75 minutes.

The averaged results are given in the following table:

Example 5

| Preservative | Solution uptake $l/m^3$ | Calculated retention % (m/m) | Sapwood penetration | Mc before treatment (%) | Mc after treatment (%) |
|---|---|---|---|---|---|
| Boric acid + Methanol | 30.3 Reduced to 14.1 | 0.80 $H_3BO_3$ | 90% | 13.08 | 19.93 Reduced to 15.99 |

It can be seen by boron spot test that impregnation of boron into wood is spontaneous and with solvent recovery, (as much as half of the solvent) boron redistribution is insignificant.

The foregoing describes the invention including a preferred form thereof. Alterations and modifications as will be obvious to those skilled in the art are intended to be incorporated in the scope hereof, as defined in the following claims.

I claim:

1. A process for the preservative or remedial treatment of timber, consisting essentially of immersing the timber in a liquid boron based preservative formulation formed by mixing boric acid or boron oxide with one or more solvents selected from the group consisting of methanol and ethanol without removing any reaction byproducts from the mixture, after first drying the timber to a mean moisture content below 15% by weight to an extent sufficient to allow rapid penetration of the preservative into the timber, whereby boron or a compound of boron becomes deposited within the timber.

2. The process according to claim 1, wherein the timber is dried to a mean moisture content below 10% by weight prior to contacting the timber with the liquid boron based preservative.

3. The process according to claim 1, wherein the timber is dried to a mean moisture content below 6% prior to contact with the liquid boron based preservative.

4. The process according to claim 1, wherein the timber is dipped into the preservative sufficiently to subject the timber to a hydrostatic pressure of at least 5 kPa to assist in impregnating the boron based preservative into the timber through hydrostatic pressure.

5. The process according to claim 4, wherein the timber is subjected to a hydrostatic pressure of at least 10 kPa.

6. The process according to claim 5, wherein the timber is contacted with the preservative by dipping the timber in the boron-based preservative for a time not greater than 3 minutes.

7. The process according to claim 6, wherein said drying comprises drying at temperatures above 100° C.

8. The process according to claim 7, wherein the timber has a moisture content of 8% by weight or more after impregnation of the boron preservative into the timber.

9. The process according to claim 1 comprising the further step of recovering methanol or ethanol initially present in the liquid boron based preservative.

10. A process for the preservative or remedial treatment of wood or wood based products with a liquid boron based preservative formed by mixing boric acid or boron oxide with one or more solvents selected from the group consisting of methanol and ethanol without removing any reaction byproducts from the mixture, consisting essentially of the steps of drying the wood or wood based product to a mean moisture content below 15% by weight to an extent sufficient to allow penetration of the preservative into the wood or wood based product and subsequently contacting the wood or wood based product with the liquid boron based preservative, whereby an amount of boron or a compound of boron becomes deposited within the wood or wood based product.

11. A process for the preservative or remedial treatment of timber, consisting essentially of spraying the timber with a liquid boron based preservative formulation formed by mixing boric acid or boron oxide with one or more solvents selected from the group consisting of methanol and ethanol without removing any reaction byproducts from the mixture, after first drying the timber to a mean moisture content below 15% by weight to an extent sufficient to allow rapid penetration of the preservative into the timber, whereby boron or a compound of boron becomes deposited within the timber.

* * * * *